US007718586B2

(12) United States Patent
Schield et al.

(10) Patent No.: US 7,718,586 B2
(45) Date of Patent: May 18, 2010

(54) HYDROCARBONS HAVING REDUCED LEVELS OF MERCAPTANS AND METHOD AND COMPOSITION USEFUL FOR PREPARING SAME

(75) Inventors: John A. Schield, Missouri City, TX (US); Weldon John Cappel, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 743 days.

(21) Appl. No.: 10/588,341

(22) PCT Filed: Feb. 11, 2004

(86) PCT No.: PCT/US2004/004011

§ 371 (c)(1),
(2), (4) Date: Aug. 3, 2006

(87) PCT Pub. No.: WO2005/087899

PCT Pub. Date: Sep. 22, 2005

(65) Prior Publication Data

US 2007/0142244 A1 Jun. 21, 2007

(51) Int. Cl.
*C10L 1/22* (2006.01)

(52) U.S. Cl. ..... 508/243; 544/224; 544/336; 544/338; 528/423; 528/424

(58) Field of Classification Search ..... 508/243–298; 585/1; 544/224, 336, 338–405; 528/423–424
See application file for complete search history.

(56) References Cited

U.S. PATENT DOCUMENTS

| | | | | | |
|---|---|---|---|---|---|
| 2,927,946 | A | * | 3/1960 | Petty | 568/55 |
| 3,144,403 | A | | 8/1964 | Jacob | |
| 3,707,552 | A | * | 12/1972 | Dobinson et al. | 560/147 |
| 4,129,455 | A | * | 12/1978 | Thompson et al. | 524/88 |
| 5,064,525 | A | | 11/1991 | Frame et al. | |

FOREIGN PATENT DOCUMENTS

| | | |
|---|---|---|
| EP | 0 067 036 | 12/1982 |
| EP | 0 499 743 | 8/1992 |
| EP | 0 538 819 | 4/1993 |
| WO | WO 02/34863 | 5/2002 |

* cited by examiner

*Primary Examiner*—Robert J Hill, Jr.
*Assistant Examiner*—Brian McCaig
(74) *Attorney, Agent, or Firm*—Mossman Kumar & Tyler PC

(57) ABSTRACT

Disclosed is composition useful for reducing the concentration of mercaptans in hydrocarbons comprising: (A) a first diazo component and (B) a second component comprising a nucleophilic acceptor. The composition can be added to hydrocarbons such as fuel oil to reduce mercaptans without increasing turbidity or color. Triethylene diamine and 1,2-epoxyhexadecane are disclosed to be exemplary diazo and nucleophilic acceptor components.

23 Claims, No Drawings

HYDROCARBONS HAVING REDUCED LEVELS OF MERCAPTANS AND METHOD AND COMPOSITION USEFUL FOR PREPARING SAME

BACKGROUND OF THE INVENTION

1. Field of the Invention

This invention relates to hydrocarbons having reduced levels of mercaptans and a method and composition for preparing the hydrocarbons having reduced levels of mercaptans. This invention particularly relates to treating hydrocarbons with a mercaptan scavenging composition to reduce mercaptan levels in the hydrocarbons.

2. Background of the Art

Mercaptans, a source of "sourness," can be present in both petroleum crude oils and in the fuels produced therewith. These compounds, having the general formula:

R—SH wherein R is an alkyl or other organic group, are generally undesirable as they have a very unpleasant smell and can have a negative impact upon the environment. For example, in Manitoba Canada, federal and provincial regulations set 0.5 parts per million (0.5 ppm) as the permissible concentration in the air.

Petroleum and other crude oils are most commonly converted into finished products in a fuel products refinery. Typically, the fuel products produced are gasoline, distillate fuels such as diesel and heating oils, and bunker or residual fuel oils. Atmospheric and vacuum distillation towers are used to separate the crude into narrow boiling fractions. A catalytic cracking unit cracks high boiling vacuum gas oil into a mixture ranging from light gases to very heavy tars and coke. In general, very heavy virgin residuum having average boiling points greater than 1100° F. (593° C.) is blended into residual fuel oil or thermally cracked into lighter products in a visbreaker or coker.

Overhead or distillate products in the refining process generally contain very little, if any, hydrogen sulfide, but may contain sulfur components found in the crude oil, including mercaptans. However, substantial amounts of mercaptans and other organo-sulfur compounds are found in vacuum distillation tower bottoms, which may be blended into gas oils and fuel oils. It is for this reason that mercaptans are often present in bunker fuel oils.

For the purposes of the present invention, "oil" is meant to include the unrefined and refined hydrocarbon products derived from petroleum or from liquefaction of coal, both of which contain sulfur compounds. Thus, the term "oil" includes, particularly for petroleum based fuels, wellhead condensate as well as crude oil which may be contained in storage facilities at the producing field and transported from those facilities by barges, pipelines, tankers, or trucks to refinery storage tanks, or, alternatively, may be transported directly from the producing facilities through pipelines to the refinery storage tanks. The term "oil" also includes refined products, interim and final, produced in a refinery, including distillates such as gasoline, distillate fuels, oils, and residual fuels.

Refined fuels must be brought within mercaptan specifications for marketability. In the processing of oils, it is desirable to eliminate or reduce atmospheric emissions of noxious mercaptan or other organo-sulfur compounds associated with sulfur containing oils, in order to improve environmental air quality at refineries. It is also desirable to remove or reduce mercaptan is fuels, particularly the bunker fuels. For example, large ships, a major user of bunker fuels, can have difficulties with environmental regulations at some ports.

Efforts have been made in the part to sweeten fuels that had sulfur compounds present. EP 0 538 819 to Roof, et al., discloses that Sour sulfhydryl group containing oils can be treated with an effective amount of a sweetening, hydrogen sulfide vapor reducing quaternary ammonium compound. The compounds disclosed in this reference are stated to be especially suitable for high boiling, heavy residual fuels under low mix conditions. EP 0 067 036 similarly discloses Quaternary ammonium hydroxides as mercaptan scavengers.

WO-0234863 to Munson discloses another method of removing mercaptans from hydrocarbon streams. In this reference, it is disclosed to use basic metal salts that react with mercaptans to form mercaptides. The metal salts are dissolved or suspended in ionic liquids, which tend to have virtually no vapor pressure. After the mercaptides are adsorbed into the ionic liquid, the demarcaptanized hydrocarbon stream can be removed, for example by distillation, decantation or gravity separation. Then the mercaptides can be oxidized, for example, by exposure to air, to form disulfides. The disulfides are insoluble in the ionic liquids, and can be readily removed.

Another reference is this art area is EP 0 499 743 to Frame, et al., which is also U.S. Pat. No. 5,064,525. Therein, it is disclosed to use a two step process for sweetening a sour hydrocarbon fraction containing tertiary mercaptans and primary or secondary mercaptans. In one step the mercaptans in the sour hydrocarbon fraction are reacted with hydrogen in the liquid phase and in the presence of a selective hydrogenolysis catalyst to selectively hydrogenolyze the tertiary mercaptans. In another step, the primary and/or secondary mercaptans are oxidized by reacting them with an oxidizing agent in the presence of oxidation catalyst and a basic component.

An older reference in this art area is U.S. Pat. No. 3,144,403 to Jacob. Therein, a process for reducing the mercaptan content of hydrocarbons by oxidation of mercaptans to disulfides is disclosed. In this process, hydrocarbons containing mercaptans are contacted with a phenylene diamine inhibitor sweetening agent and oxygen in the presence of an alkaline catalyst consisting essentially of a solid anion exchange resin. The process further includes separating the hydrocarbons having reduced mercaptan content from the solid resin.

SUMMARY OF THE INVENTION

In one aspect, the present invention is a composition useful for reducing the concentration of mercaptans in hydrocarbons comprising: (A) a first component having the general formula:

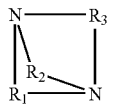

wherein: (i) $R_1$, $R_2$, and $R_3$ are independently saturated or unsaturated alkyl groups, and (ii) at least two of $R_1$, $R_2$, and $R_3$ include a chain of at least two carbon atoms bonded to the two N atoms; and (B) a second component comprising a nucleophilic acceptor.

In another aspect, the present invention is a method of reducing the concentration of mercaptans in a hydrocarbon comprising admixing a composition useful for reducing the concentration of mercaptans in hydrocarbons comprising: (A) a first component having the general formula:

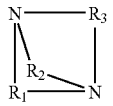

wherein: (i) $R_1$, $R_2$, and $R_3$ are independently saturated or unsaturated alkyl groups, and (ii) at least two of $R_1$, $R_2$, and $R_3$ include a chain of at least two carbon atoms bonded to the two N atoms; and (B) a second component comprising a nucleophilic acceptor; with a hydrocarbon having a first concentration of mercaptans greater than 0 under reaction conditions sufficient to produce a hydrocarbon having a second concentration of mercaptans that is less than the first concentration of mercaptans.

In still another aspect, the present invention is a hydrocarbon having a reduced concentration of mercaptans comprising the product of admixing a composition useful for reducing the concentration of mercaptans in hydrocarbons comprising: (A) a first component having the general formula:

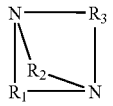

wherein: (i) $R_1$, $R_2$, and $R_3$ are independently saturated or unsaturated alkyl groups, and (ii) at least two of $R_1$, $R_2$, and $R_3$ include a chain of at least two carbon atoms bonded to the two N atoms; and (B) a second component comprising a nucleophilic acceptor; with a hydrocarbon having a first concentration of mercaptans greater than 0 under reaction conditions sufficient to produce a hydrocarbon having a second concentration of mercaptans that is less than the first concentration of mercaptans.

DESCRIPTION OF THE PREFERRED EMBODIMENTS

In one aspect, the present invention is a composition useful for reducing the concentration of mercaptans in hydrocarbons. For purposes of the present invention, a hydrocarbon is any petroleum or coal based oil, or products produced from a petroleum or coal based oil wherein there mercaptans, if present, would be undesirable. For example the hydrocarbon can be a crude oil, but it can also be a fuel oil such as a bunker oil or other product produced from crude oil.

In the practice of the method of the present invention, a hydrocarbon is admixed with a composition useful for reducing the concentration of mercaptans in hydrocarbons. The composition useful for reducing the concentration of mercaptans in hydrocarbons of the present invention has at least two components. The first component is a diazo compound having the general formula:

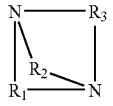

wherein: (i) $R_1$, $R_2$, and $R_3$ are independently saturated or unsaturated alkyl groups, and (ii) at least two of $R_1$, $R_2$, and $R_3$ include a chain of at least two carbon atoms bonded to the two N atoms. One example of the first component is triethylene diamine which is also known as 1,4-diazabicyclo (2.2.2) octane and DABCO. Other diazo compounds useful as the first component of the present invention include, but are not limited to the group consisting of: 1,8-diazabicyclo(5.4.0) undec-7-ene, 1,5-diazabicyclo(4.3.0) non-5-ene, and mixtures thereof. Any diazo compound having the general formula of the first component can be used with the present invention. Mixtures of such compounds can also be used.

The composition useful for reducing the concentration of mercaptans in hydrocarbons of the present invention has a second component that is a nucleophilic acceptor. Nucleophilic acceptors are sometimes also referred to as proton donors. For the purposes of the present invention, a nucleophilic acceptor is any compound that can accept a nucleophile. Compounds that can be used as the second component of the composition of the present invention include isocyanates, isothiocyanates, activated esters, acid chlorides, sulfonyl chlorides, activated sulfonamides, activated heterocycles, activated heteroaryls, chloroformates, cyanoformates, thioesters, phosphoryl chlorides, phosphoramidates, epoxides, aromatic halides, alkyl halides, imidates, and lactones and mixtures thereof. Preferably, the nucleophilic acceptors of the present invention are selected from the group consisting of epoxides, aromatic halides, alkyl halides and mixtures thereof.

When the nucleophilic acceptor of the present invention is an epoxide, it preferably is a $C_6$-$C_{24}$ epoxide. In one embodiment, the nucleophilic acceptor of the present invention is a C12-C16 epoxide. In another embodiment, the nucleophilic acceptor of the present invention is $C_{20}$-$C_{24}$ epoxide. In still another embodiment, the nucleophilic acceptor of the present invention is $C_2$-$C_8$ epoxide. Exemplary epoxides include, but are not limited to 1,2-epoxyhexadecane, 1,2-epoxydodecane, 1,2-epoxyoctane, 1,2-epoxybutane, and mixtures thereof.

When nucleophilic acceptor of the present invention is an aromatic halide, it is preferably an aromatic chloride. For example, in one embodiment of the present invention, the nucleophilic acceptor is benzyl chloride or 1-chloro-2-ethylbenzene. The nucleophilic acceptor can also be a combination of such materials.

When the nucleophilic acceptor of the present invention is an alkyl halide, it is preferably an alkyl iodide or chloride. For example, the nucleophilic acceptor can be an alkyl chloride such as n-butyl chloride or sec-butyl chloride. In another embodiment, the nucleophilic acceptor of the present invention can be a methyl iodide.

In the method of the present invention, the two components of the composition of the present invention are admixed with a hydrocarbon having a first concentration of mercaptans greater than 0 under reaction conditions sufficient to produce a hydrocarbon having a second concentration of mercaptans that is less than the first concentration of mercaptans. The two components can be used in a molar ratio of about 1:1, but can also be used in a molar ratio of from about 1:99 to about 99:1. It is believed that the nucleophilic acceptor is consumed during the reduction of the mercaptans, so an excess of the nucleophilic acceptor can be used with a molar ratio of diazo component to nucleophilic acceptor of 1:10 being preferred in one embodiment and a molar ratio of 1:5 being preferred in another embodiment. The amount used will vary depending upon the initial concentration of mercaptans in the hydrocarbon to be treated and the desired level to be present after treatment, but preferably this amount will be from about 10 to about 1000 parts per million (ppm). In some embodiments of the present invention, this range will be from about 100 to about 900 ppm. In still other embodiments, the range will be from about 100 to about 200 ppm.

The diazo component and the nucleophilic acceptor component of the composition of the present invention can be added to a hydrocarbon simultaneously, sequentially, or even sequentially with a delay between the additions. This latter mode of addition is limited to situation where there is no deactivating material in the hydrocarbon to be treated. When added simultaneously, it is desirable that the two components be in the form of a solution or suspension in a solvent. When a solvent is used, preferably is an aromatic solvent such as xylenes and the like. One embodiment of the present invention includes SOLVESSO 100 as solvent which is an aromatic solvent available from Imperial Oil Ltd. In one embodiment, the solvent is selected to be compatible with the hydrocarbon to be treated.

In one embodiment of the present invention, an alcohol is used as part of the solvent to increase the compatibility of the first component. Alcohols useful for this function of the present invention include, but are not limited to the group consisting of dipropylene glycol, 1,4-butanediol, iso-propanol and mixtures thereof. The alcohols useful with the present invention are both polar and oil soluble.

In practicing the method of the present invention, the composition useful for reducing the concentration of mercaptans in hydrocarbons is admixed with a hydrocarbon using any method of mixing known to those of ordinary skill in the art of mixing hydrocarbons to be useful. In one embodiment, the composition of the present invention is admixed with a hydrocarbon using an in-line mixer during the production of a fuel in a refinery. In another embodiment, the composition of the present invention is admixed with a hydrocarbon using a recycle pump and a holding tank. In still another embodiment of the present invention, the composition of the present invention is added to a shipment of fuel and the motion from shipping used to admix the fuel and composition.

While not wishing to be bound by any theory, it is believed that the composition of the present invention functions in a several step process to reduce mercaptan concentration in hydrocarbons. In a first step, it is believed that the diazo component forms a salt with the mercaptan. In a subsequent step, the nucleophilic acceptor then reacts with the salt to form a sulfide, alcohol and regenerate the diazo component. There may be additional intermediate steps to this mechanism.

The composition of the present invention is directed towards the removal of mercaptans, not hydrogen sulfide. The diazo component of the composition of the present invention will react with hydrogen sulfide to form a salt, but the diazo compound is not regenerated, thus hydrogen sulfide can deactivate or render the composition of the present invention ineffective. Therefore, when practicing the method of the present invention, it can be desirable to remove hydrogen sulfide, if present, using a hydrogen sulfide scavenger. One advantage of the present invention as compared to such scavengers and other conventional mercaptan reduction compositions is the composition of the present invention does not, in many instances, cause turbidly or color formation. This can be an advantage in some applications. The composition of the present invention can also include additives such as, for example, peroxides to inhibit or remove color.

EXAMPLES

The following examples are provided to illustrate the present invention. The examples are not intended to limit the scope of the present invention and they should not be so interpreted. Amounts are in weight parts or weight percentages unless otherwise indicated.

Example 1

Blank

A 1000 gram gasoline sample is admixed with 0.24 grams of 1-propanethiol. The sample is then retained for 4 hours at 78° F. (35.6° C.) and an aliquot taken and tested for mercaptans as [S]. The sample is retained for an additional 20 hours at the same temperature and a second aliquot taken and tested for mercaptans as [S] using ASTM D3227. The results are shown below in Table 1. A gasoline sample prepared as in this blank is further treated with a 500 ppm of an additive prepared using 25 g, dipropylene glycol, 25 g xylene, 5 g triethylene diamine, and 45 g of 1,2-epoxyhexadecane. It is treated and tested substantially identically as the blank and the results are reported below in Table 1.

Example 2

Example 1 is repeated substantially identically except that 24.1 grams of dipropylene glycol, 24.1 g of xylene, 8.4 g triethylene diamine, and 43.4 g of 1,2-epoxyhexadecane is used. The results are reported below in Table 1.

Example 3

Example 1 is repeated substantially identically except that 15 grams of dipropylene glycol, 35 g of xylene, 5 g triethylene diamine, and 45 g of 1,2-epoxyhexadecane is used. The results are reported below in Table 1.

Example 4

Example 1 is repeated substantially identically except that 19.88 grams of dipropylene glycol, 30.12 g of xylene, 6.63 g triethylene diamine, and 43.37 g of 1,2-epoxyhexadecane is used. The results are reported below in Table 1.

Comparative Example I

Example 1 is repeated substantially identically except that no dipropylene glycol or triethylene diamine is used to prepare the additive. Instead the additive is prepared using 37.5 g of xylene, 12.5 g piperidine, and 50 g of 1,2-epoxyhexadecane. The results are reported below in Table 1.

TABLE 1

| Sample ID | Dipropylene Glycol % | Xylene % | Triethylene Diamine % | 1,2-epoxy-hexadecane % | Piperidine % | [S]ppm 4 hours | [S]ppm 24 hours |
|---|---|---|---|---|---|---|---|
| Blank | — | — | — | — | — | 107.8 | 109.7 |
| Ex. 1 | 25 | 25 | 5 | 45 | — | 87.5 | 47.2 |
| Ex. 2 | 24.1 | 24.1 | 8.4 | 43.4 | — | 79.16 | 38.1 |
| Ex. 3 | 15 | 35 | 5 | 45 | — | 82.8 | 60.3 |
| Ex. 4 | 19.8 | 30.1 | 6.6 | 43.4 | — | 64.3 | 34.3 |
| Comp. Ex. I | — | 37.5 | — | 50 | 12.5 | 108.3 | 85.2 |

Example 5

Blank

A gasoline sample is retained for 4 hours at 78° F. (35.6° C.) and an aliquot taken and tested for mercaptans as [S] using ASTM D3227. The results are shown below in Table 2.

A gasoline sample is prepared as is this blank and is further treated with a 500 ppm of an additive prepared using 19.9 g, dipropylene glycol, 33.7 g xylene, 6.6 g triethylene diamine, and 43.4 g of 1,2-epoxyhexadecane. It is tested substantially identically as the blank and the results are reported below in Table 2.

TABLE 2

| Sample ID | Dipropylene Glycol % | Xylene % | Triethylene Diamine % | 1,2-epoxy-hexadecane % | [S]ppm 4 hours |
|---|---|---|---|---|---|
| Blank | — | — | — | — | 6.4 |
| Ex. 5 | 25 | 25 | 5 | 45 | 1.6 |

Example 6

Blank

A 900 gram gasoline sample is admixed with 0.21 grams of 1-propanethiol. The sample is then retained for 4 hours at 78° F. (35.6° C.) and an aliquot taken and tested for mercaptans as [S] using ASTM D3227. The sample is retained for an additional 20 hours at the same temperature and a second aliquot taken and tested for mercaptans as [S] using ASTM D3227. The results are shown below in Table 3.

A gasoline sample prepared as in this blank is further treated with a 500 ppm of an additive prepared using 15.7 g dipropylene glycol, 43.5 g A-150 (an aromatic solvent), 5.2 g triethylene diamine, 1.3 g cumene hydroperoxide, and 34.2 g of 1,2-epoxyhexadecane. It is treated and tested substantially identically as the blank and the results are reported below in Table 3.

Example 7

Example 6 is repeated substantially identically except that 15.9 grams of dipropylene glycol, 44.1 g of A-150, 5.3 g triethylene diamine, and 34.7 g of 1,2-epoxyhexadecane is used. The results are reported below in Table 3.

Example 8

Example 6 is repeated substantially identically except that using 19.9 g, dipropylene glycol, 33.7 g xylene, 6.6 g triethylene diamine, and 43.4 g of 1,2-epoxyhexadecane is used. The results are reported below in Table 3.

TABLE 3

| Sample ID | Dipropylene Glycol % | Solvent % | Triethylene Diamine % | 1,2-epoxy-hexadecane % | Cumene Hydro-peroxide % | [S]ppm 4 hours | [S]ppm 24 hours |
|---|---|---|---|---|---|---|---|
| Blank | — | — | — | — | — | 139 | 136 |
| Ex. 6 | 15.7 | 43.5[a] | 5.2 | 34.2 | 1.3 | 91 | 83 |
| Ex. 7 | 15.9 | 44.1[a] | 5.3 | 34.7 | — | 109 | 72 |
| Ex. 8 | 15.9 | 44.1[b] | 5.3 | 34.7 | — | 90 | 76 |

[a]Solvent is A-150.
[b]Solvent is xylene.

What is claimed is:

1. A composition useful for reducing the concentration of mercaptans in hydrocarbons comprising:

(A) a first component having the general formula:

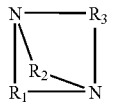

wherein: (i) $R_1$, $R_2$, and $R_3$ are independently saturated or unsaturated alkyl groups, and (ii) at least two of $R_1$, $R_2$, and $R_3$ include a chain of at least two carbon atoms bonded to the two N atoms;

(B) a second component comprising a nucleophilic acceptor;

(C) an alcohol selected from dipropylene glycol, 1,4-butanediol, and isopropanol; and (D) a sour hydrocarbon;

wherein components A, B, and C are admixed with the sour hydrocarbon.

2. The composition of claim 1 wherein the first component is selected from the group consisting of: 1,4-diazabicyclo(2.2.2)octane; 1,8-diazabicyclo(5.4.0)undec-7-ene; 1,5-diazabicyclo(4.3.0)non-5-ene; and mixtures thereof.

3. The composition of claim 2 wherein the first component is 1,4-diazabicyclo(2.2.2)octane.

4. The composition of claim 1 wherein the second component comprising a nucleophilic acceptor is selected from the group consisting of: isocyanates, isothiocyanates, activated esters, acid chlorides, sulfonyl chlorides, activated sulfonamides, activated heterocycles, activated heteroaryls, chloroformates, cyanoformates, thioesters, phosphoryl chlorides, phosphoramidates, epoxides, aromatic halides, alkyl halides, imidates, and lactones and mixtures thereof.

5. The composition of claim 4 wherein the second component comprising a nucleophilic acceptor is selected from the group consisting of: epoxides, aromatic halides, alkyl halides, and mixtures thereof.

6. The composition of claim 5 wherein the second component comprising a nucleophilic acceptor is an epoxide.

7. The composition of claim 6 wherein the second component comprising a nucleophilic acceptor is 1,2-epoxyhexadecane.

8. The composition of claim 1 wherein component (A) and component (B) are in a molar ratio of from about 1:99 to about 99:1.

9. The composition of claim 8 wherein component (A) and component (B) are in a molar ratio of from about 1:1 to about 1:10.

10. The composition of claim 9 wherein component (A) and component (B) are in a molar ratio of about 1:5.

11. The composition of claim 1 additionally comprising a solvent.

12. The composition of claim 11 wherein the solvent is an aromatic solvent.

13. The composition of claim 11 wherein the solvent is an aromatic solvent is xylene.

14. A method of reducing the concentration of mercaptans in a hydrocarbon comprising admixing a composition comprising:

(A) a first component having the general formula:

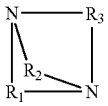

wherein: (i) $R_1$, $R_2$, and $R_3$ are independently saturated or unsaturated alkyl groups, and (ii) at least two of $R_1$, $R_2$, and $R_3$ include a chain of at least two carbon atoms bonded to the two N atoms;

(B) a second component comprising a nucleophilic acceptor; and (C) an alcohol selected from dipropylene glycol, 1,4-butanediol, and isopropanol with a hydrocarbon having a first concentration of mercaptans greater than 0 under reaction conditions sufficient to produce a hydrocarbon having a second concentration of mercaptans that is less than the first concentration of mercaptans.

15. The method of claim 14 wherein the composition is present at a concentration of from about 10 to about 1000 parts per million (ppm).

16. The method of claim 15 wherein the composition is present at a concentration of from about 100 to 900 ppm.

17. The method of claim 15 wherein the composition is present at a concentration of from about 100 to 200 ppm.

18. The method of claim 14 wherein the composition is admixed with the hydrocarbon using an in-line mixer.

19. The method of claim 14 wherein the composition is admixed during shipping.

20. The method of claim 14 additionally comprising the steps of determining the hydrogen sulfide content of the hydrocarbon and using a hydrogen sulfide scavenger to reduce the level of hydrogen sulfide before admixing the hydrocarbon with the composition comprising:

(A) a first component having the general formula:

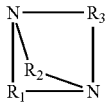

wherein: (i) $R_1$, $R_2$, and $R_3$ are independently saturated or unsaturated alkyl groups, and (ii) at least two of $R_1$, $R_2$, and $R_3$ include a chain of at least two carbon atoms bonded to the two N atoms;

(B) a second component comprising a nucleophilic acceptor; and (C) an alcohol selected from dipropylene glycol, 1,4-butanediol, and isopropanol.

21. A hydrocarbon having a reduced concentration of mercaptans comprising a product of admixing a composition comprising:

(A) a first component having the general formula:

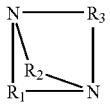

wherein: (i) $R_1$, $R_2$, and $R_3$ are independently saturated or unsaturated alkyl groups, and (ii) at least two of $R_1$, $R_2$, and $R_3$ include a chain of at least two carbon atoms bonded to the two N atoms;

(B) a second component comprising a nucleophilic acceptor; and (C) an alcohol selected from dipropylene glycol, 1,4-butanediol, and isopropanol, with a hydrocarbon having a first concentration of mercaptans greater than 0 under reaction conditions sufficient to produce a hydrocarbon having a second concentration of mercaptans that is less than the first concentration of mercaptans.

22. The hydrocarbon of claim 21 wherein the hydrocarbon is a fuel oil.

23. The hydrocarbon of claim 22 wherein the hydrocarbon is a residual fuel oil.

* * * * *